US005190317A

United States Patent [19]

Zoland

[11] Patent Number: 5,190,317

[45] Date of Patent: Mar. 2, 1993

[54] ONE HOLE FOLDER

[76] Inventor: Martin Zoland, 7 Mandeville Crescent, Toorak, Victoria 3142, Australia

[21] Appl. No.: 793,866

[22] Filed: Nov. 18, 1991

[51] Int. Cl.[5] ..... B42D 3/00

[52] U.S. Cl. ..... 281/30; 281/31; 281/45; 462/71

[58] Field of Search ..... 281/30, 31, 29, 15.1, 281/45; 462/71

[56] References Cited

U.S. PATENT DOCUMENTS 2,192,607 3/1940 Anderson ..... 281/30
2,606,041 8/1952 Misiak, Jr. ..... 281/30
4,566,721 1/1986 Friedman et al. ..... 281/30
5,029,899 7/1991 Schieppati et al. ..... 281/30

*Primary Examiner*—Mark Rosenbaum
*Assistant Examiner*—Willmon Fridie, Jr.
*Attorney, Agent, or Firm*—Blakely, Sokoloff, Taylor & Zafman

[57] ABSTRACT

A folder and writing instrument in combination, wherein the writing instrument is hooked to a front cover or back cover of the folder via a through-hole located on one of said covers. Preferably, the through-hole is located on the back cover and the front cover does not completely overlie the back cover thereby exposing the edge opposite to the spine of the folder. A writing instrument attached to the through-hole in this exposed area can be freely accessed and does not interfere with opening or closing of the front cover.

12 Claims, 1 Drawing Sheet

ONE HOLE FOLDER

BACKGROUND OF THE INVENTION

1. Field of the Invention

The present invention relates to a folder. More precisely, the present invention relates to the combination of a folder and a writing instrument attached thereto.

2. Description of the Prior Art and Related Information

Quite often, people who attend business meetings or school remember to bring their note pad but sometimes forget a writing instrument. Therefore, many methods have been devised to connect one with the other. Many popular note pads or folders include a small pocket in the interior lining designed to carry a pen. In other prior art note pads, a spring loaded clip attached to the interior of one cover clamps down on a writing tablet and provides a small loop for carrying the writing instrument.

U.S. Pat. No. 5,011,188 to Zoland et al. discloses a pen and folder combination. The folder has a hole disposed through both the front and back covers in an aligned orientation. A clip typically found on a pen can thus be hooked into the hole to simultaneously secure the pen to the folder and to clasp the covers of the folder together.

SUMMARY OF THE INVENTION

The present invention provides a novel combination of a writing instrument and a folder wherein the writing instrument can be easily latched to the folder. In a preferred embodiment, the present invention provides a through-hole located near an edge of a back cover of the folder. The through-hole is adapted to receive a pocket clip typically found on many conventional pens. Thus, a pen or other writing instrument can be secured to the folder by hooking the clip through the hole.

The present invention provides a superior method of holding the pen to the folder than the conventional practice of simply clipping the pen to an edge of one cover of the folder. Further, the hole can be shaped so that there is a snug fit between the clip and the hole thereby minimizing the chance of the clip unexpectedly slipping out of the hole.

In the preferred embodiment, the present invention provides that the top cover not completely overlie the bottom cover, thus partially exposing the bottom cover. With the hole located in the bottom cover at the exposed area, it is possible for the folder to close flat and to not cover the writing instrument.

In an alternative embodiment, the present invention provides that the through-hole be disposed on the top cover of the folder. Since the pen merely clips to the top cover, the folder can be opened or closed without interference from the clip. Accordingly, the present invention provides a simple mechanism for attaching a writing instrument to a folder or notebook.

DETAILED DESCRIPTION OF THE INVENTION

In the following description, numerous details such as specific materials and configurations are set forth in order to provide a more complete understanding of the present invention. But it is understood by those skilled in the art that the present invention can be practiced without those specific details. In other instances, well-known elements are not described explicitly so as not to obscure the present invention.

Figure 1:
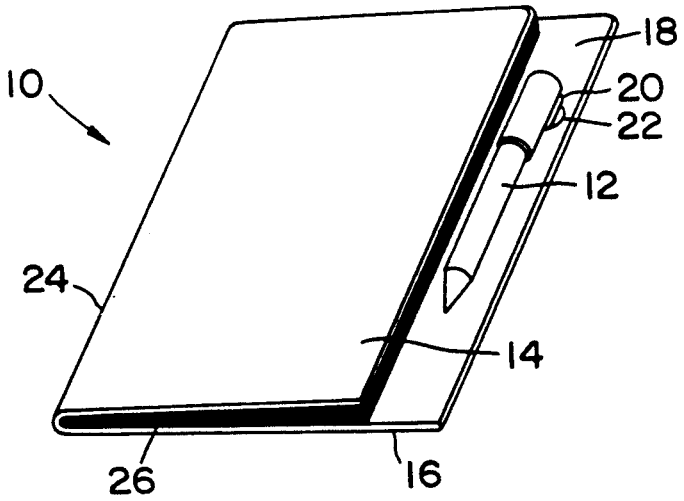
FIG. 1 is a perspective view of a preferred embodiment of the present invention, wherein a pen is clipped to the back cover of a folder by hooking the clip of the pen on the through-hole.

FIG. 1 shows a preferred embodiment of the present invention. A folder 10 is shown having a front cover 14 and a back cover 16 hinged at a common edge called the spine 24. The folder is preferably designed to carry papers 26 between the front and rear covers 14 and 16. The folder 10 can be a manila folder, a notebook, a writing tablet, or the like.

Unique in the present invention is a through-hole 22 disposed on the back cover 16 of the folder 10. The purpose of the through-hole 22 is to provide a point of attachment for a writing instrument 12. As shown in the perspective view of FIG. 1, the writing instrument 12, here a pen, is hooked to the back cover 16 via the through-hole 22. The hooking is accomplished by a pocket clip 20, found on almost all conventional pens and markers.

Figure 2:
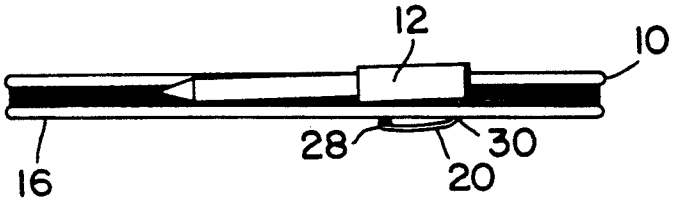
FIG. 2 is a profile view of the notebook and pen combination shown in FIG. 1 clearly depicting the clip hooking on to the back cover.

FIG. 2 provides a side view of the folder and pen combination illustrated in FIG. 1. As is detailed in the drawing, one can see that the clip 20 of the writing instrument 12 passes through the through-hole 22. A distal end 28 of the writing instrument 12 hooks against the underside of the back cover 16. A proximal end of the clip 20 rides at the lip of the through-hole 22.

For the sake of esthetics and convenience, the front cover 14 does not completely overlie the back cover 16 so that an exposed area 18 is created. The exposed area 18, as shown in FIG. 1, permits easy access to the writing instrument 12. Since the folder 10 is hinged at spine 24, opening and closing the folder 10 is not interfered with by the clipped writing instrument 12.

To improve durability, the present invention provides that the through-hole 22 be reinforced with another layer of material if necessary or stiffened with a metal or plastic ring. Indeed, the entire exposed area 18 can be reinforced or made from a stiff material to minimize unwanted bending. Other methods of bracing the through-hole 22 or the exposed area 18 are known in the art can be applied here as well.

Figure 3:
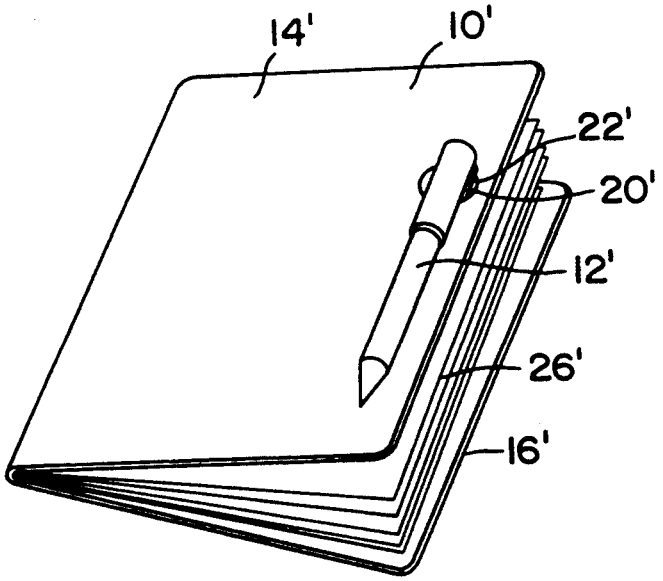
FIG. 3 is a perspective view of an alternative embodiment of the present invention wherein the pen is hooked to the front cover of the folder.

FIG. 3 illustrates an alternative embodiment of the present invention. In particular, the folder 10' has a through-hole 22' disposed in the front cover 14'. Similar to the preferred embodiment, the alternative embodiment utilizes the through-hole 22' to secure a writing instrument 12' to the front cover 14'. Again, a conventional clip 20' commonly found on most writing instruments is used to perform the hooking function. Since the writing instrument 12' only hooks to the front cover 14, the contents of the folder 10' such as papers 26' carried therein are not affected by the clip 20'.

Naturally, the through-hole can be located on various other locations of the front cover or the back cover with the associated writing instrument connected in various orientations. These variations are within the scope and spirit of the present invention as defined in the appended claims.

What is claimed is:

1. A folder and writing instrument combination, said writing instrument including a longitudinal body and a clip, said clip having proximal and distal ends with said proximal end affixed to said writing instrument, said folder including a front cover with an inside portion and an outside portion and a back cover with an inside portion and an outside portion, said front cover and said back cover being joined at one side thereof so as to form a spine, said front and back covers having first and second edges adjacent said spine and a third edge opposite said spine, said combination comprising:

a through-hole located in said back cover adjacent said third edge, said through-hole adapted to receive said clip by a substantially perpendicular insertion of said distal end of said clip through said through-hole, said clip holding said writing instrument in place by clipping against said outside portion of said back cover to clamp said back cover against said longitudinal body of said writing instrument.

2. A folder and writing instrument combination according to claim 1, wherein said front cover partially overlies said back cover thus exposing said third edge of said back cover and said writing instrument.

3. A folder and writing instrument combination according to claim 1, wherein said third edge of said back cover is reinforced with a strip of material which is stiffer than the folder material and which is placed along said third edge.

4. A folder and writing instrument combination according to claim 1, wherein said through-hole is located substantially midmay on said third edge of said back cover between said first and second edges.

5. A folder and writing instrument combination according to claim 1, wherein a periphery of said through-hole is reinforced with a stiffening means.

6. A folder and writing instrument combination according to claim 5, wherein said through-hole has a substantially rectangular shape.

7. A folder and writing instrument combination, said writing instrument including a longitudinal body and a clip, said clip having proximal and distal ends with said proximal end affixed to said writing instrument, said folder including a front cover with an inside portion and an outside portion and a back cover with an inside portion and an outside portion, said front cover and said back cover being joined at one side thereof so as to form a spine, said front and back covers having first and second edges adjacent said spine and a third edge opposite said spine, said combination comprising:

a through-hole located in said front cover adjacent said third edge, said through-hole adapted to receive said clip by a substantially perpendicular insertion of said distal end of said clip through said through-hole, said clip holding said writing instrument in place by clipping against said inside portion of said front cover to clamp said front cover against said longitudinal body of said writing instrument.

8. A folder and writing instrument combination according to claim 7, wherein said back cover partially overlies said front cover thus exposing said third edge of said front cover and said writing instrument.

9. A folder and writing instrument combination according to claim 7, wherein said third edge of said front cover is reinforced with a strip of durable material placed along said third edge.

10. A folder and writing instrument combination according to claim 7, wherein said through-hole is located substantially midway on said third edge of said front cover between said first and second edges.

11. A folder and writing instrument combination according to claim 7, wherein a periphery of said through-hole is reinforced with a stiffening means.

12. A folder and writing instrument combination according to claim 7, wherein said through-hole has a substantially rectangular shape.

* * * * *